US005355816A

United States Patent [19]

Echevarria

[11] Patent Number: 5,355,816

[45] Date of Patent: Oct. 18, 1994

[54] QUILTING AND MULTIPLE LAYER SHIRRING FOR BEDDING

[76] Inventor: Michael A. Echevarria, 200 E. Angelino #104, Burbank, Calif. 91502

[21] Appl. No.: 875,278

[22] Filed: Apr. 28, 1992

[51] Int. Cl.[5] ..... D05B 11/00; A47G 9/00

[52] U.S. Cl. ..... 112/2.1; 112/129; 112/132; 112/262.3; 5/451

[58] Field of Search ..... 112/262.1, 262.3, 266.1, 112/420, 427, 2.1, 132, 129; 5/448, 449, 451, 482

[56] References Cited

U.S. PATENT DOCUMENTS

| | | | |
|---|---|---|---|
| 2,627,302 | 2/1953 | Forsyth | 155/179 |
| 2,653,558 | 9/1953 | Kruglick | 112/132 |
| 2,935,958 | 5/1960 | Kuhn | 112/132 |
| 3,104,633 | 9/1963 | Newman | 112/132 X |
| 3,190,247 | 6/1965 | Schifano et al. | 112/262.1 X |
| 3,198,149 | 8/1965 | Schlegel | 112/420 X |
| 3,242,508 | 3/1966 | Smithson | 112/420 X |
| 3,635,178 | 1/1972 | Levinstein et al. | 112/132 |
| 4,042,986 | 8/1977 | Goodman et al. | 5/335 |
| 4,221,013 | 9/1980 | Echevarria | 5/451 |
| 4,384,541 | 5/1983 | Schneider | 112/262.1 X |
| 4,466,367 | 8/1984 | Price et al. | 112/262.1 X |
| 4,569,706 | 2/1986 | Echevarria et al. | 156/69 |
| 4,619,211 | 10/1986 | Semon et al. | 112/132 |
| 4,883,009 | 11/1989 | Haselberger et al. | 112/266.1 |
| 5,056,441 | 10/1991 | Seago | 112/2.1 |
| 5,080,267 | 1/1992 | Yogo | 112/132 |

FOREIGN PATENT DOCUMENTS

| | | | |
|---|---|---|---|
| 274162 | 10/1965 | Australia . | |
| 0032160 | 8/1984 | Japan | 112/129 |

*Primary Examiner*—Clifford D. Crowder
*Assistant Examiner*—Ismael Izaguirre
*Attorney, Agent, or Firm*—Henry M. Bissell

[57] ABSTRACT

A shirring blade assembly is added to a quilting machine to enable the fabrication of a shirred topmost quilting layer on an upper sleeping surface of a mattress fabricated by the machine. The various layers to be laminated into the quilted upper sleeping surface include filler and foam layers for resilience. As the various layers are fed through the quilting machine, the shirring blade assemblies reciprocate in and out to gather the material in the desired shirred configuration, and the configuration is fixed by stitching along selectively spaced stitch lines. The resulting product is cut, trimmed and beaded about its periphery, after which it is incorporated in a mattress.

13 Claims, 3 Drawing Sheets

QUILTING AND MULTIPLE LAYER SHIRRING FOR BEDDING

BACKGROUND OF THE INVENTION

1. Field of the Invention.

This invention relates to an improved mattress and body support surface construction and, more particularly, to one which results in a more comfortable, durable and esthetically pleasing product including a shirred outer surface.

2. Description of the Related Art.

Many ways of constructing mattresses and body support surfaces are known in the prior art. Among the more modern types of bedding are mattresses which comprise springs mounted in suitable supporting members, foam rubber or plastic inserts which provide the desired resiliency. Another common approach is to provide a plurality of water filled cylinders arranged within a central box or chamber and covered with an intermediate or buffer body support surface. Prior to the development of such a combination, bags in the shape of mattresses, filled with water (so-called "waterbeds"), were in common use in certain circles. These, however, developed an unfavorable connotation because of their extreme weight, propensity for leaking, the continuing wave action following any movement of the sleeper, and for other reasons. Air mattresses are in common use as available spare beds for overnight guests. In addition, mattresses incorporating individually adjustable pneumatic cylinders in place of the water filled elements mentioned above are coming into vogue. Foam mattresses are also known.

In many of these configurations, it is desirable to provide an upper sleeping surface with an intermediate or buffer layer of selected resilience to establish a buffer between the sleeper and the primary support mechanism. This is commonly achieved by the use of a separate mattress pad. One such pad which incorporates a fitted border with a tensioning means for holding the pad in place, relative to the mattress on which it is installed, is disclosed in Echevarria et al U.S. Pat. No. 4,042,986. The disclosed construction incorporates a buffer surface for placement along the upper side of a mattress with at least one layer of repeatedly impacted foam, quilted together with a ticking and a porous backing, together with fitted borders having tensioning means in order to compensate for particular mattress defects and enhance the comfort and esthetic appeal to the user of such a structure. This patent also discloses the methods of fabrication of such a mattress pad. The entire disclosure of U.S. Pat. No. 4,042,986 is incorporated herein by reference.

Echevarria U.S. Pat. No. 4,221,013 shows the construction of the sleeping surface of a fluid flotation sleep system incorporating a plurality of fluid-filled cylinders as the primary support medium. This patent discloses a centrally disposed urethane foam layer overlying the fluid-filled elements and covered with a quilted top surface of polyurethane foam and polyester ticking. The combination foam layer and ticking provides a rich finished appearance together with soft but firm surface feel which also provides substantial thermal insulation and may be attached to the urethane foam layer which overlies the fluid-filled elements.

SUMMARY OF THE INVENTION

In brief, arrangements in accordance with the present invention comprise particular apparatus incorporated in a quilting machine to effect the gathering of at least the topmost layer of a quilted sleeping surface to establish a shirred configuration of the topmost layer. The invention also encompasses the method of fabrication practiced by the quilting machine and the product produced thereby.

Preferably, the quilted sleeping surface of the invention comprises a top layer of quilting or ticking fabric, a thin layer of non-woven material, a layer of fluffed polyester fiber filament material, somewhat like raw cotton, a sheet of resilient polyurethane foam approximately half the thickness of the filler layer and, finally, a backing layer of non-woven polyester. In the finished product, these layers are stitched together along straight line stitching lines spaced apart on nominal 12-inch (30.48 cm )centers. The pleats in the shirred top layer run approximately at right angles to the stitching lines. There is some gathering of the second layer which is next to the uppermost quilting layer where the maximum shirring occurs, although it is not as pronounced as the gathering in the topmost layer. The second layer of non-woven polyester is effective in enhancing the gathering of the topmost layer to develop the shirred effect.

Modifications of conventional quilting machine apparatus to develop the shirring equipment of the present invention involve the installation of a plurality of shirring blades together with corresponding actuating apparatus which causes the shirring blades to move into the machine toward the first bank of needles, as the needles and associated presser foot are raised. This action of extending and retracting the shirring blades in synchronism with the needles and presser foot serves to regularly gather the quilting material as the sleep surface is being fabricated so that the shirring of the topmost layer is developed. The modified quilting machine employed in embodiments of the present invention utilizes a signal from a microswitch activated according to the location of the needle bars to cause the shirring blades to advance the upper layer of quilting fabric to achieve the gathering of the material.

BRIEF DESCRIPTION OF THE DRAWING

A better understanding of the present invention may be realized from a consideration of the following detailed description, taken in conjunction with the accompanying drawing, in which.

DETAILED DESCRIPTION OF THE PREFERRED EMBODIMENTS

The Prior Art

Figure 1:
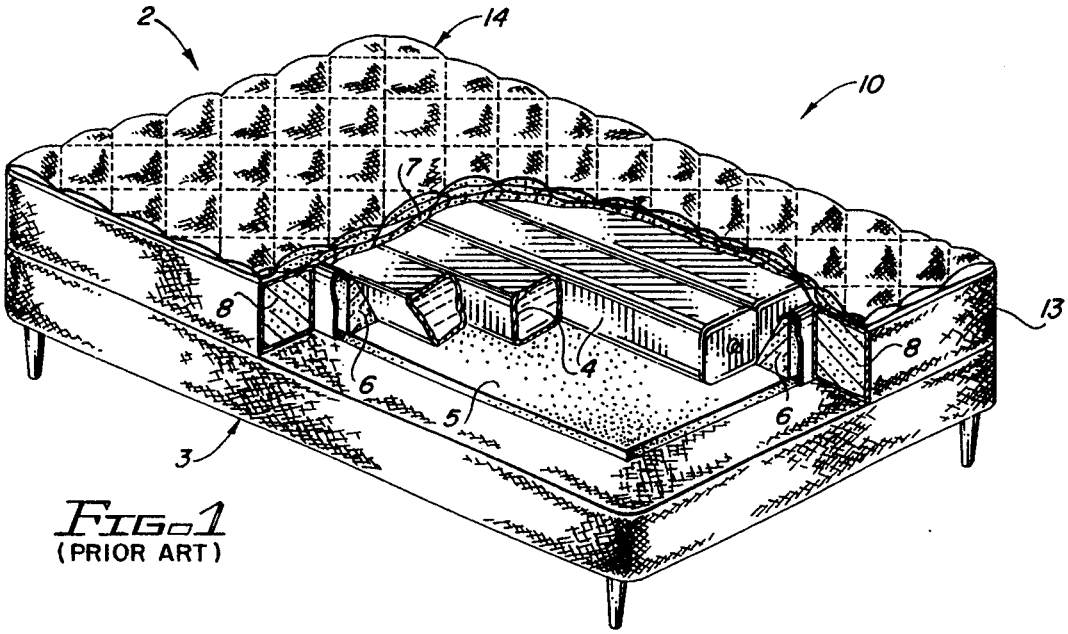
FIG. 1 (PRIOR ART)
FIG. 1 is a schematic drawing partially broken away, showing the construction of a currently marketed flotation support surface having a plurality of water-filled cylinders as the primary support medium.

For purposes of illustration, a particular construction of a fluid flotation sleeping surface in which the present invention may be utilized to advantage is depicted in FIG. 1. This shows a fluid flotation sleeping surface 10 wherein the exterior of the structure is formed as a pair of bordered panels or frames 2 and 3, the outer margins of which have substantial height and register together so as to define an interior cavity or enclosed volume into which a plurality of water-filled containers 4 are placed. The bottom panel structure 3 comprises a base urethane foam sheet 5, to the outer periphery of which is secured a border member 6 comprising a wedge-shaped or inclined foam wall which is joined to the margin of the base foam sheet 5 about its periphery. The region defined within the inclined surfaces of the wedges 6 comprises a well or open cavity under the principal sleeping surface of the mattress 10. The top panel has a centrally disposed urethane foam layer 7 and an outer peripheral border 8 of resilient foam of rectangular cross section that is substantially the height of the mattress. The mattress or sleeping surface 10 has a quilted top surface 14 of polyurethane foam layers 16, 17 and polyester ticking 15, the foam layer 16 being of significant height so that the foam layer 16 is unified with the ticking 15. A side quilted margin 13, which may be of urethane fabric, extends around the periphery. A plurality of water containers 4 are shown within the interior cavity to provide the primary support for the sleeping surface.

Figure 2:
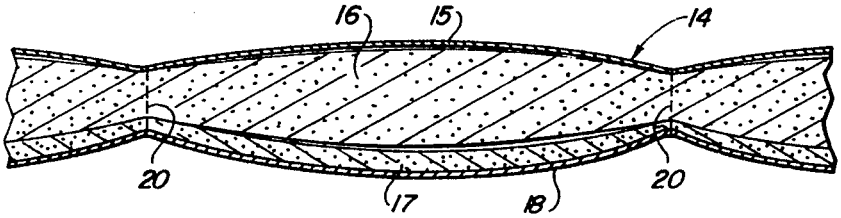
FIG. 2 (PRIOR ART)
FIG. 2 is a cross-sectional view of a portion of the upper quilted buffer surface of FIG. 1.
Figure 3:
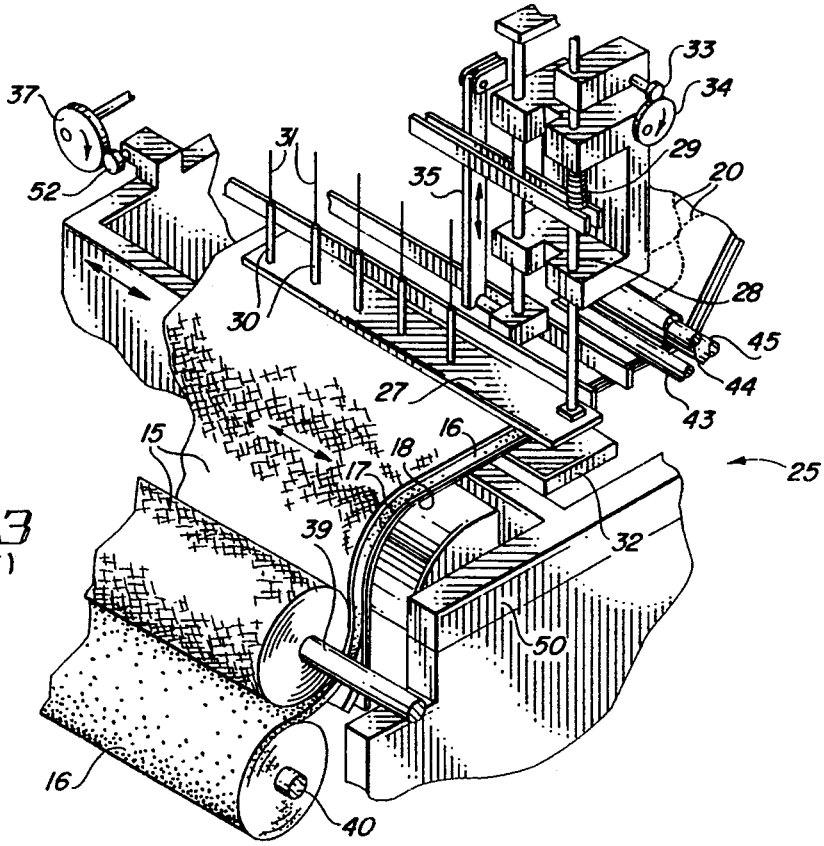
FIG. 3 (PRIOR ART)
FIG. 3 is a schematic view of a stitching machine for the fabrication for the quilted surface of FIG. 2.

FIGS. 2 and 3 are taken from the Echevarria et al U.S. Pat. No. 4,042,986 to show the fabrication and construction of the quilted top layer of the mattress of FIG. 1. Although the disclosure of U.S. Pat. No. 4,042,986 is directed to the fabrication of what is essentially a mattress cover, the fabrication machinery and method are essentially the same for the upper quilted layer 14 of FIG. 1. Rather than being fabricated as a separate mattress cover for placement upon a mattress, as in U.S. Pat. No. 4,042,986, the quilted layer 14 of FIG. 1 is adhered in place to the upper surface of the upper frame of the mattress of FIG. 1.

As is shown in FIG. 2, the upper surface of the mattress cover of U.S. Pat. No. 4,042,986 comprises a multilayer laminate 14 which consists of an upper surface of ticking material 15, an upper foam sheet 16, a lower foam sheet 17, and a bottom or inferior surface of backing fabric 18. Both foam sheets 16 and 17 are formed of polyurethane foam of selected thickness. The quilting operation performed by the quilting machine of FIG. 3 develops an areal pattern of stitching 20 across the buffer member 10. This pattern of stitching can be varied according to the desired design. That which is shown in FIG. 1 is particularly attractive, both for its esthetic appeal and for the comfort and support afforded by the essentially closed individual cells which are formed by the stitching design.

As illustrated generally in FIG. 3, a quilting machine 25, depicted only schematically, comprises a modified Edgewater multi-needle quilting machine which includes a needle presser foot 27 which is reciprocated vertically by guide rods 28 in timed relation to the advance and lateral shifting of the layers 15–18 for the quilted body that are to be moved through the machine. Vertically disposed needles 30 through which yarns 31 are threaded reciprocate vertically through apertures in the needle presser foot 27 in timed relation to feed-through of the quilted body and depression of the needle presser foot 27. The needle presser foot 27 impacts downward against the laminate at each step, compressing the interior foam against the upper surface of a needle plate 32 across which it moves. The impacting force is increased and the cycle time is reduced by compression springs 29 on the guide rods 28. A presser foot lifter cam 33 mechanism controls the reciprocation of the presser foot 27, this cam mechanism including a rotating cam lobe 34 that provides an extended vertical travel of the pressure foot. A connecting rod 35 coupled to a conventional needle bar block and needle bar assembly supporting the needles 30 is reciprocated vertically in synchronism with the movement of the presser foot 27. A number of guide rods 28 and connecting rods 35 are disposed along the span of the presser foot 27, but only one of each has been shown for simplicity.

Concurrently with the reciprocating action of the presser foot 27 and associated rods and needles, a drive cam 37 of selected configuration for the particular quilting pattern being generated introduces transverse motion of the quilted body relative to the presser foot 27. Supply rollers 39, 40 (only two of which are shown) for the layers 15–18, feed rollers 43, 44 and 45 adjacent the presser foot 27 and a take-up reel (not shown) are mounted on a carriage 50 which is reciprocated by a cam follower 52 engaging the drive cam 37. The mechanism has been simplified for clarity and brevity in FIG. 3 inasmuch as it need only be appreciated that a relatively thick multi-layer laminate can in fact be quilted.

The Preferred Embodiment

Figure 4:
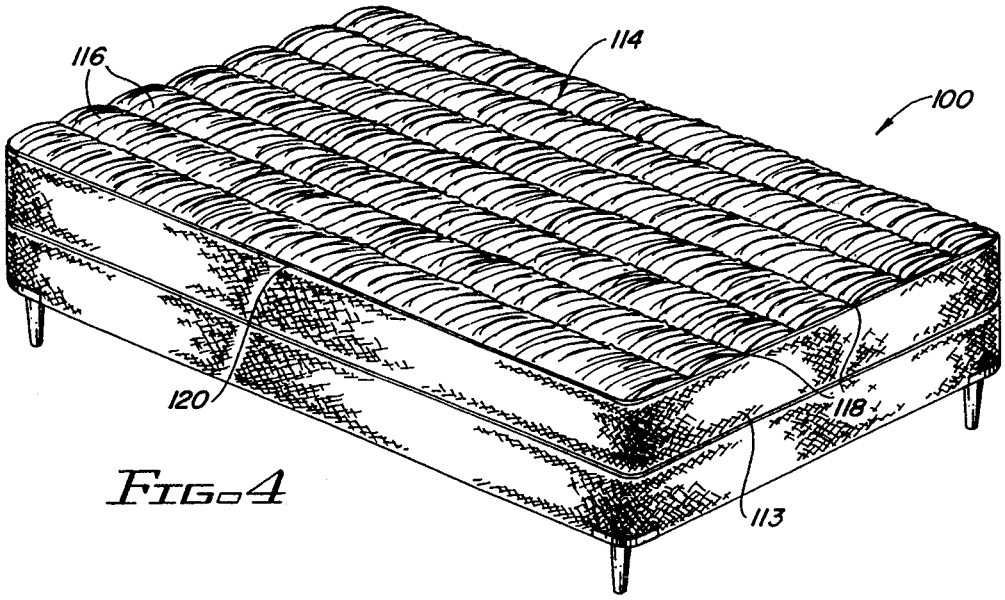
FIG. 4 is a view of a mattress having an upper sleeping surface constructed in accordance with the principles of the present invention.

A preferred embodiment of the present invention in the form of a mattress having an upper sleeping surface in accordance with the present invention is represented in FIG. 4. The mattress 100 of FIG. 4 may be considered equivalent to the mattress 10 in FIG. 1, except that the upper sleeping surface 114 and side panels 113 are different in appearance and construction. The upper sleeping surface 114 is provided with rows of shirred material 116 between generally parallel straight lines of stitching 118. The periphery is bounded by a bead 120 which extends about the upper surface 114.

Figure 5:
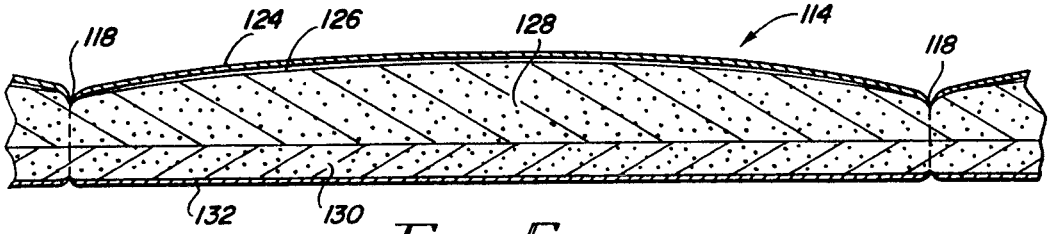
FIG. 5 is a cross-sectional view of a portion of the upper sleeping surface of the arrangement of FIG. 4, taken in a direction transverse to the lines of stitching in the upper surface.

The construction of the upper sleeping surface 114 is illustrated in the cross-sectional view of FIG. 5 which represents a portion of the sleeping surface 114 extending generally transversely to the stitching lines 118. This shows the top layer of fabric 124, with a layer of non-woven material 126 immediately under it. Next is a relatively thick filler layer 128 of fluffed polyester fiber filler. This material has a weight of from approximately 0.5 oz. to 1.25 oz. per square foot (152.44 grams to 390.98 grams per square meter). Beneath the filler 128 is a layer 130 of resilient polyurethane foam. Finally, beneath the polyurethane foam 130, is a backing layer 132 of non-woven polyester. As indicated, these are all bound together by the stitching 118.

Figure 6:
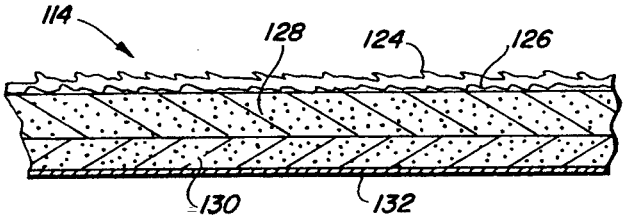
FIG. 6 is a partial sectional view of the upper sleeping surface of FIG. 4, taken in a direction orthogonal to that of FIG. 5.

FIG. 6 is another sectional view of a portion of the upper sleeping surface 114, taken generally at right angles to the sectional view of FIG. 5. The top layer 124 is represented in a gathered configuration with the shirred material configured in a series of loose pleats which are manually adjustable relative to each other except at the stitch lines 118, where they are fixed in position. The under layer of non-woven material 126 is shown gathered to a certain extent, but less than the shirred top layer 124. The layer 126, being somewhat slippery, facilitates the sliding of the top layer 124 relative to the fill layer 128. During the shirring step, the top layer 124 slides relative to the layer 126, which in turn slides relative to the fill layer 128.

Figure 7:
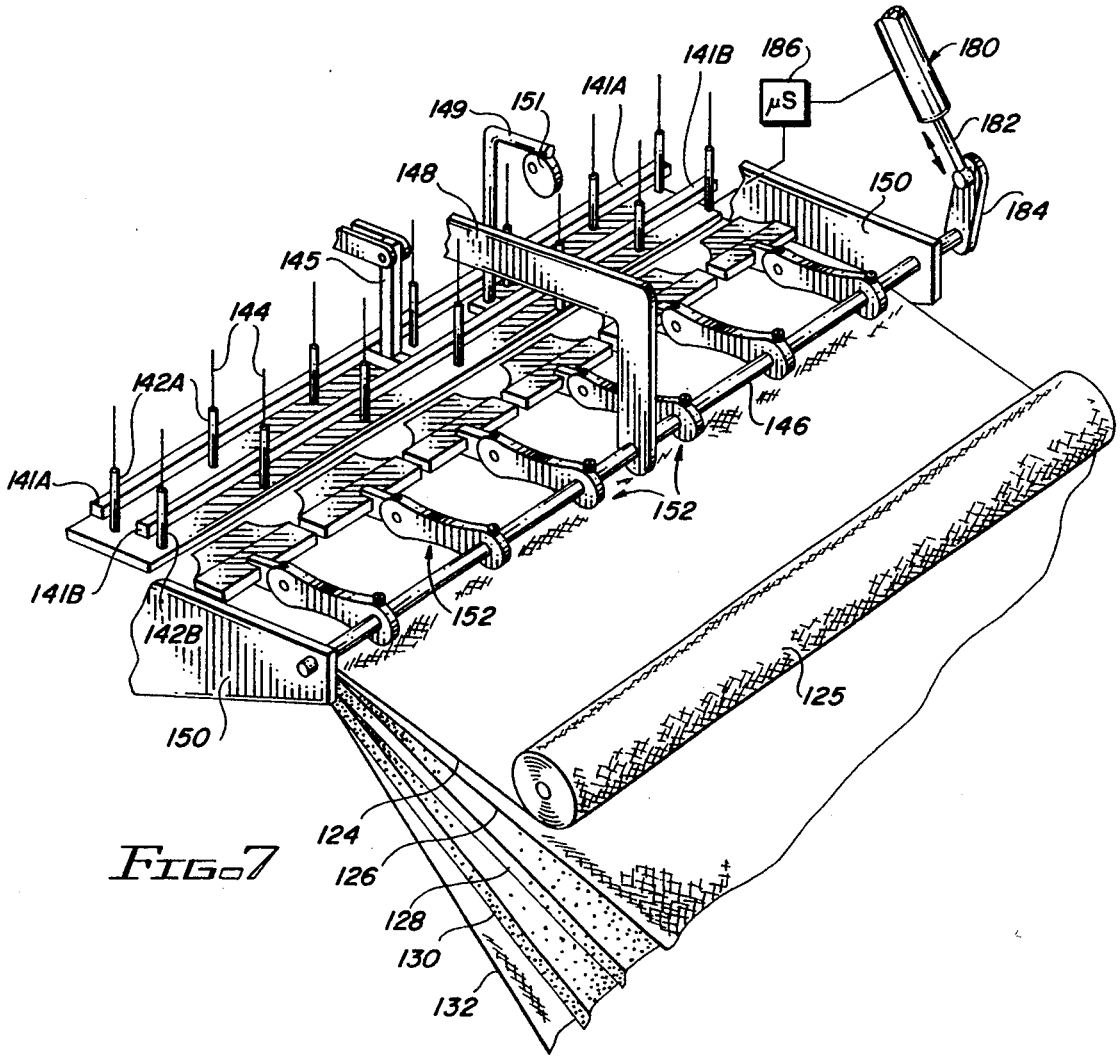
FIG. 7 is a schematic view of a shirring blade assembly in accordance with the present invention which is added to the stitching machine of FIG. 3 to produce the product shown in FIG. 4.

FIG. 7 is a schematic view illustrating the shirring apparatus which is used in conjunction with the quilting machine represented in FIG. 3. Pertinent portions of the FIG. 3 machine are shown in FIG. 7 for completeness, with new reference numerals assigned. For example, the presser foot is designated 140 and two sets of needles 142A, 142B are shown respectively attached to corresponding needle bars 141A, 141B which are joined to a vertically reciprocating mechanism 145. The presser foot 140 is arranged to be reciprocated vertically by rod 149 having a cam follower segment adjacent a cam 151. These vertically reciprocating mechanisms may be provided in multiples for stability; only one set of each is shown for simplicity. Each of the needles 142A, 142B is threaded with threads 144 which extend to spools (not shown) positioned above the frame. The needles 142A and 142B are in line to provide the lines of stitching 118 and serve to provide reinforcement of the stitching with redundancy so that if one thread 144 happens to break, the entire quilted panel does not have to be re-stitched. This also permits replacement of a thread spool without having to shut down the machine.

Brackets 150, extensions of the side frames 50 of FIG. 3, support a transverse shaft 146. An additional support 148 for the shaft 146 is installed midway between the ends of the shaft 146. The quilting machine in which my modification is installed may be obtained from Edgewater Machine Company of College Point, N.Y.

Figure 8:
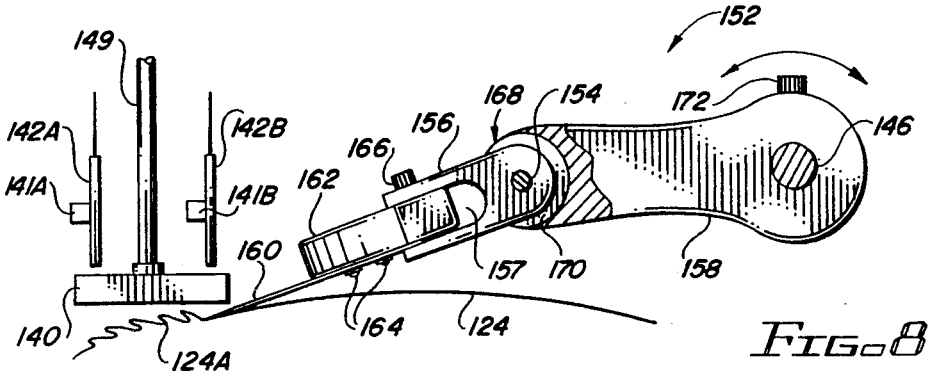
FIG. 8 is a schematic view of particular elements of FIG. 7 showing the conceptual operation of the shirring apparatus of the invention.
Figure 9:
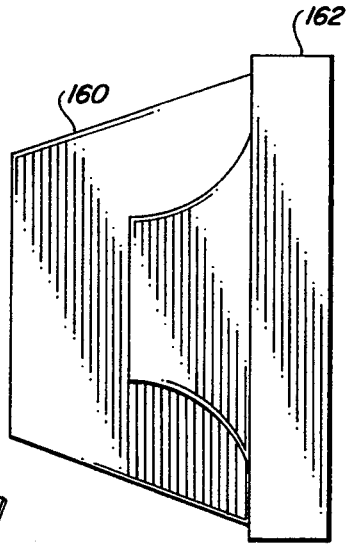
FIG. 9 is a plan view of one of the blade units of FIG. 7.

Mounted on the shaft 146 are a plurality of blade assemblies 152, each having a pivot shaft 154 between a blade holder 156 and a pivot arm 158. Details of one of these blade assemblies 152 are shown in FIG. 8. The blade and blade backing member are shown in FIG. 9. The blade 160 is affixed to the underside of the backing member 162 by mounting means 164, which may comprise spot welding, screws or other adhering elements. The blade holder 156 has a pocket 157 for receiving a backing member 162 which is held in position by a retaining screw 166. As indicated in FIG. 7, the pivot arm 158 has a split end 168 defining a slot 170 for receiving the blade holder 156. A threaded retaining screw 172 locks the arm 158 on the shaft 146 to develop rotation therewith. The blade assemblies 152 are regularly spaced along the shaft 146 in accordance with the spaces between the needles 142. Each blade 160 has its front corners cut off so as to avoid contact with the needles 142.

The quilting machine of FIGS. 3 and 7 (combined) includes an actuator 180 having a reciprocating rod 182 pivotably attached to a lever 184 mounted on the shaft 146. This actuator 180 is connected to be controlled by a microswitch 186 which is responsive when timed to the vertical movement of the presser foot 140. The presser foot 140 moves in synchronism with the needles 142 and needle bars 141 but leads the needles slightly on the downstroke and begins the upward movement just after the needles are withdrawn from the laminated material. As the presser foot 140 is lifted, a microswitch 186 provides a momentary signal to the actuator 180. This causes the actuator 180 to extend the rod 182, thereby pivoting the shaft 146 clockwise to withdraw the blades 160 to a position where they can pick up the next extent of the top quilting layer 124. As the presser foot 140 is being moved downwardly, the actuator 180 retracts the rod 182, thereby pivoting the shaft 146 in the counterclockwise direction (FIG. 8) so that the blades 160 push the topmost quilting layer underneath the presser foot 140. This causes the top quilting layer 124 to advance under the presser plate 140 to a greater extent than the remaining layers 126, 128, 130, 132. The layer 126 follows to some extent, as indicated in FIG. 6, advancing slightly more than the layers 128, 130 and 132 which are being pulled through the quilting machine by the feed rollers 43–45 in conventional fashion. The extent of the gathering of the uppermost layer is variable by adjusting the rod 182 which is screw-threaded into the actuator 180. A preferred setting is that which gathers the uppermost fabric at a ratio of 2:1, compared with the fill and foam layers. A ratio of 1.75:1 is also acceptable.

After a sufficient extent of the laminated upper surface material has been prepared by the quilting machine (FIGS. 3 and 5), a unit is cut and trimmed to the correct size and the bead 120 is stitched about the periphery thereof. The upper sleeping surface 114 is then affixed in position along the upper side of a layer like the layer 7 of FIG. 1 to complete the mattress 100 of FIG. 4. This mattress is non-specific as to its interior construction regarding its support elements. It may, for example, contain a plurality of fluid filled containers like those in FIG. 1 (either water or air filled), or it may utilize springs or other known types of support elements beneath the quilted sleeping surface constructed in accordance with my invention.

It should be noted that the cam 37 and follower 52 of FIG. 3 are inactive during the operation of this quilting machine in the manner described, since the support table is not moved from side to side during the stitching of the straight lines. If desired, a zigzag pattern could be developed, utilizing the cam 37 and follower 52, in which case only one of the needle bars 141 and associated set of needles 142 would be used.

Through the use of the apparatus and fabrication methods of the present invention in providing the shirred upper sleeping surface of FIG. 4, an extremely effective and esthetically pleasing product results. The top quilted layer is shirred with loosely pleated folds and gatherings stitched in place along the stitch lines 118. The expansion of the compressed fill layer 128 pushes outwardly between the stitch lines 118 to develop the puffy, shirred effect shown in FIG. 4. While this configuration is preferred, the esthetic effect of the shirred top layer of the disclosed sleeping surface can be achieved with other layer and material combinations. If need be, the fill layer could be dispensed with, as well as the non-woven layer next to the shirred uppermost layer, provided that the upper surface of the foam layer is sufficiently slippery to enable the top fabric layer to slide along it to permit the gathering of the top layer.

Although there have been described hereinabove various specific arrangements of a method and apparatus for fabricating bedding in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Quilting apparatus for producing a sleeping surface having a shirred uppermost fabric layer comprising: p1 a frame for supporting a plurality of layers of material to be laminated to form said sleeping surface;

feed roll means for advancing said layers along said frame during the laminating thereof;

means including a plurality of needles for stitching said layers together along predetermined stitch lines as the layers are advanced along said frame;

a plurality of shirring blade assemblies mounted along said frame generally transversely of said stitch lines, each assembly being positioned between a corresponding pair of adjacent stitch lines, each assembly including a shirring blade which is movable between a first position in which the blade is retracted to frictionally engage a segment of said uppermost fabric layer and a second position in which the blade is extended to advance said segment of said uppermost fabric layer relative to the other layers of said plurality;

means for selectively moving the blades of said assemblies between said first and said second positions to establish the shirred configuration of said uppermost fabric layer; said selectively moving means including:

a pivotable shaft extending generally transversely of said frame with said shirring blade assemblies being attached to said shaft at transversely spaced positions for pivotable movement therewith, and an adjustable member coupled to said shaft for determining the extent of the segment of the uppermost fabric layer which is frictionally engaged by the blades;

each blade assembly comprising a lever arm fixedly mounted to said shaft and a blade holder pivotably coupled to the lever arm at a point remote from the shaft, said blade holder having a shirring blade attached thereto; and means for pivoting said shaft in order to rotate the lever arms of said blade assemblies in unison to move said blades between said first and second positions, wherein the advancement of said blades from said first position to said second position frictionally engages said uppermost fabric layer and the layer next adjacent thereto to develop different degrees of advancement of said layers relative to the remainder of the layers of said plurality.

2. The apparatus of claim 1 wherein said stitching means comprise at least one needle bar mounting a set of said needles for reciprocating movement in unison along paths generally transverse to the frame to establish a plurality of stitches along said stitch lines.

3. The apparatus of claim 2 further comprising a presser foot mounted for reciprocating movement generally transverse to the frame between a first position in which the pressure foot compresses the layers of material against the frame in preparation for stitching and a second position spaced from the frame sufficiently to permit advancing the layers of material along the frame by said feed roll means.

4. The apparatus of claim 3 further including means for activating said feed rollers and the advancement said shirring blades concurrently during the time when said presser foot and said needles are raised away from stitching said layers.

5. The apparatus of claim 3 further including means for lowering said presser foot to retain the material of the uppermost fabric layer and the adjacent layer in the positions advanced by said shirring blades for stitching by said needles.

6. The apparatus of claim 3 wherein said second position of said blade is adjacent said presser foot first position for moving gathered segments of said uppermost fabric layer underneath said presser foot.

7. The apparatus of claim 4 further including means for lowering said presser foot to retain the material of the uppermost fabric layer in the positions advanced by said shirring blades for stitching by said needles.

8. The apparatus of claim 1 wherein said feed roll means include a plurality of feed rollers for advancing the stitched layers of material through said apparatus as the needles stitch said layers together.

9. The method of fabricating a sleeping surface having a shirred uppermost fabric layer comprising the steps of:

assembling a plurality of layers of material to be laminated to form said sleeping surface, said layers comprising at least an uppermost layer of quilting fabric, an intermediate layer of resilient polyurethane foam, a bottom layer of non-woven material and further including a layer of non-woven polyester adjacent the uppermost layer of quilting fabric and a filler layer of fluffed fill material adjacent the non-woven polyester layer;

periodically advancing the layers of material to the vicinity of a bank of stitching needles;

at regular intervals between the advancement of said layers applying a presser foot to momentarily compress the layers in preparation for stitching;

while said layers are compressed, activating a bank of needles to stitch said layers together along a pattern of generally parallel, uniformly spaced lines;

during the advancement of said layers while said needles are withdrawn from stitching engagement with said layers, causing rotating a pivotable shaft on which a plurality of shirring blades are mounted, first to retract said blades to a position for picking up a predetermined extent of said uppermost fabric layer and then to extend said blades to cause at least the uppermost fabric layer to advance by an extent greater than the advancement of the remaining layers in order to gather a segment of the uppermost fabric layer in a shirred configuration;

advancing the non-woven polyester layer adjacent the uppermost fabric layer by an extent which is less than the extent of gathering of the uppermost fabric layer but exceeds the extent of advancement of the remaining layers; and stitching through all of said layers in the vicinity of the gathered segments to retain the shirred configuration of the uppermost fabric layer.

10. The method of claim 9 wherein the ratio of the extent of gathering of the uppermost layer relative to the advancement of those layers which are not gathered is variable.

11. The method of claim 9 wherein the extent of advancement of the uppermost fabric layer relative to those layers which are not gathered is approximately 2:1.

12. The method of claim 9 wherein the extent of advancement of the uppermost fabric layer relative to those layers which are not gathered is approximately 1.75:1.

13. The method of claim 9 wherein the stitching pattern comprises substantially straight lines.

* * * * *